US009661922B2

(12) United States Patent
Ehmke et al.

(10) Patent No.: US 9,661,922 B2
(45) Date of Patent: May 30, 2017

(54) OUTDOOR MODULAR FRAME SYSTEM

(71) Applicant: Sunset Bay Outdoor, Milwaukee, WI (US)

(72) Inventors: Robert Ehmke, Menomonee Falls, WI (US); Joseph Ehmke, Germantown, WI (US)

(73) Assignee: Sunset Bay Outdoor, Milwaukee, WI (US)

( * ) Notice: Subject to any disclaimer, the term of this patent is extended or adjusted under 35 U.S.C. 154(b) by 537 days.

(21) Appl. No.: 14/188,797

(22) Filed: Feb. 25, 2014

(65) Prior Publication Data

US 2015/0238009 A1 Aug. 27, 2015

(51) Int. Cl.

| | |
|---|---|
| ***A47B 47/03*** | (2006.01) |
| ***A47B 81/00*** | (2006.01) |
| ***A47B 77/02*** | (2006.01) |

(52) U.S. Cl.

CPC ..... *A47B 81/00* (2013.01); *A47B 77/02* (2013.01)

(58) Field of Classification Search

CPC ..... A47B 47/00; A47B 47/0091; A47B 47/02; A47B 47/03; A47B 77/02; A47B 81/00

USPC ..... 312/100, 257.1, 265.1, 265.3, 265.5, 312/265.6, 102, 140

See application file for complete search history.

(56) References Cited

U.S. PATENT DOCUMENTS

| | | | | |
|---|---|---|---|---|
| 4,018,020 | A * | 4/1977 | Sauer | E04B 2/7457 52/241 |
| 4,023,326 | A * | 5/1977 | Azuma | E06B 3/92 160/372 |
| 5,010,702 | A * | 4/1991 | Daw | E04B 2/82 52/241 |
| 5,380,083 | A | 1/1995 | Jones et al. | |
| 8,499,508 | B2 | 8/2013 | Sonderkaer | |
| 8,511,293 | B2 | 8/2013 | Thompson et al. | |
| 2006/0061242 | A1* | 3/2006 | Chang | A47B 77/08 312/100 |
| 2007/0170136 | A1 | 7/2007 | Kenny | |
| 2010/0148641 | A1 | 6/2010 | Ehmke | |
| 2012/0153782 | A1 | 6/2012 | Fraser | |
| 2013/0113343 | A1 | 5/2013 | Singlak et al. | |

* cited by examiner

*Primary Examiner* — James O Hansen

(74) *Attorney, Agent, or Firm* — Ziolkowski Patent Solutions Group, SC

(57) ABSTRACT

An outdoor modular system includes a plurality of vertical support pieces and a plurality of panel wall assemblies selectively engagable with the plurality of vertical support pieces, wherein a respective panel wall assembly is secured between a pair of adjacent vertical support pieces via one of thumb screws and set screws positioned in the screw holes of vertical support pieces. Each of the plurality of vertical support pieces include a support piece mating feature comprising at least one of notches, grooves, channels, and flanges, and a screw hole formed in the vertical support piece for receiving one of a thumb screw and a set screw therein. In addition, each panel wall assembly includes a set of vertical and horizontal framing pieces encompassing a decorative panel assembly, and at least one fastener configured to secure the set of vertical framing pieces to the set of horizontal framing pieces.

15 Claims, 10 Drawing Sheets

OUTDOOR MODULAR FRAME SYSTEM

BACKGROUND OF THE INVENTION

Embodiments of the invention relate generally to outdoor modular frame systems and, in particular, to a modular frame system and method for inserting and securing decorative panels to the modular frame.

Current trends have increased the sophistication of outdoor cooking and outdoor entertaining. A growing number of people are constructing outdoor structures to house cooking appliances—such as gas grills, charcoal grills, and smokers—and heat appliances—such as fireplaces and fire pits. These structures bring the benefit of greater storage space and a larger countertop surface for activities such as food preparation, as well as a better aesthetic presentation of the outdoor living space.

The construction of permanent outdoor structures can be time consuming and expensive. In addition, a permanent outdoor structure limits a user's ability to redesign his outdoor space. As a result, an outdoor structure having modular components can be an appealing alternative to a permanent structure, as a modular structure allows the user to build, knock-down, and re-build the outdoor structure in multiple configurations quickly, inexpensively, and without the help of a skilled craftsman. Further, the use of decorative panels to imitate the user's preferred exterior allows the user to achieve the look of stucco, masonry, tile, wood, or other exterior materials without the cost associated with those products.

Currently, outdoor modular structures install the decorative panels on the outside of the modular frame, and secure each decorative panel with a multitude of fasteners after the modular frame has been constructed, such as screws, rivets or other semi-permanent fasteners. This method of securing decorative panels to the modular structures involves extra time as well as extra tools to complete the construction of the modular structure. Further, exposed edges of decorative panels can result in unintentional damage to the decorative panel that could otherwise be avoided by covering the edges of the decorative panels with the modular framing.

Therefore, there is a need for an outdoor modular system designed to interfit panel assemblies having a decorative panel with vertical sections to create the modular frame, and further secure each panel assembly via a simple fastener that does not require the use of tools, such as a thumb screw. This system would simplify construction and decrease the amount of time required for assembly. Such a system would also increase durability of the structure as the edges of each decorative panel, arguably the most vulnerable part of the decorative panel, would be protected by additional components of the panel assembly.

BRIEF DESCRIPTION OF THE INVENTION

In accordance with one aspect of the invention, an outdoor modular system includes a plurality of vertical support pieces and a plurality of panel wall assemblies selectively engagable with the plurality of vertical support pieces, wherein a respective panel wall assembly is secured between a pair of adjacent vertical support pieces via one of thumb screws and set screws positioned in the screw holes of vertical support pieces. Each of the plurality of vertical support pieces include a support piece mating feature comprising at least one of notches, grooves, channels, and flanges, and a screw hole formed in the vertical support piece for receiving one of a thumb screw and a set screw therein. In addition, each panel wall assembly includes a set of vertical and horizontal framing pieces encompassing a decorative panel assembly, and at least one fastener configured to secure the set of vertical framing pieces to the set of horizontal framing pieces.

In accordance with another aspect of the invention, a method of constructing an outdoor modular system including providing a plurality of panel wall assemblies each comprising a decorative panel assembly surrounded by a set of vertical and horizontal panel framing pieces, providing a plurality of vertical support pieces that are mateable with the plurality of panel wall assemblies, and joining the plurality of panel wall assemblies to the plurality of vertical support pieces via a mating feature formed on each of the plurality of panel wall assemblies and each of the plurality of vertical support pieces, wherein the mating feature comprises at least one of notches, grooves, channels, and flanges formed therein that provide for a sliding engagement between a respective panel wall assembly and vertical support piece. In addition, the method includes securing the vertical support piece to the panel wall assemblies via at least one of one of a thumb screw and a set screw associated with each vertical support piece, wherein each of the one of the thumb screw and the set screw is threaded through a screw hole formed in the vertical support piece to apply a pressure to a respective panel wall assembly.

In accordance with yet another aspect of the invention, a panel wall assembly for use in a modular frame system, the panel wall assembly having a decorative panel assembly, a first and second vertical panel framing piece and a first and a second horizontal panel framing piece positioned about the decorative panel assembly so as to encompass the decorative pane assembly, and a plurality of fasteners to secure the first and second vertical panel framing pieces to the first and second horizontal panel framing pieces. Additionally, each of the first and second vertical panel framing pieces includes a first and second flange to interfit with a third flange and a channel of a vertical support piece of the modular frame system via a vertical sliding engagement.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to an outdoor modular system designed to interfit panel assemblies having a decorative panel with vertical sections of a modular frame and to mechanisms for securing each panel assembly in the modular frame. While a particular embodiment of the invention is described here below with respect to such a outdoor modular system being used for housing/enclosing a gas grill, it is recognized that embodiments of the invention may also be used with other outdoor cooking appliances (e.g., charcoal grills, smokers, etc.) and heat appliances (e.g., fireplaces, fire pits, etc.). As such, the scope of the invention should not be limited by the specific embodiments and examples described in detail herein, and it is recognized that any of a number of suitable outdoor appliances or systems may be incorporated into outdoor modular systems of the present invention.

Figure 1:
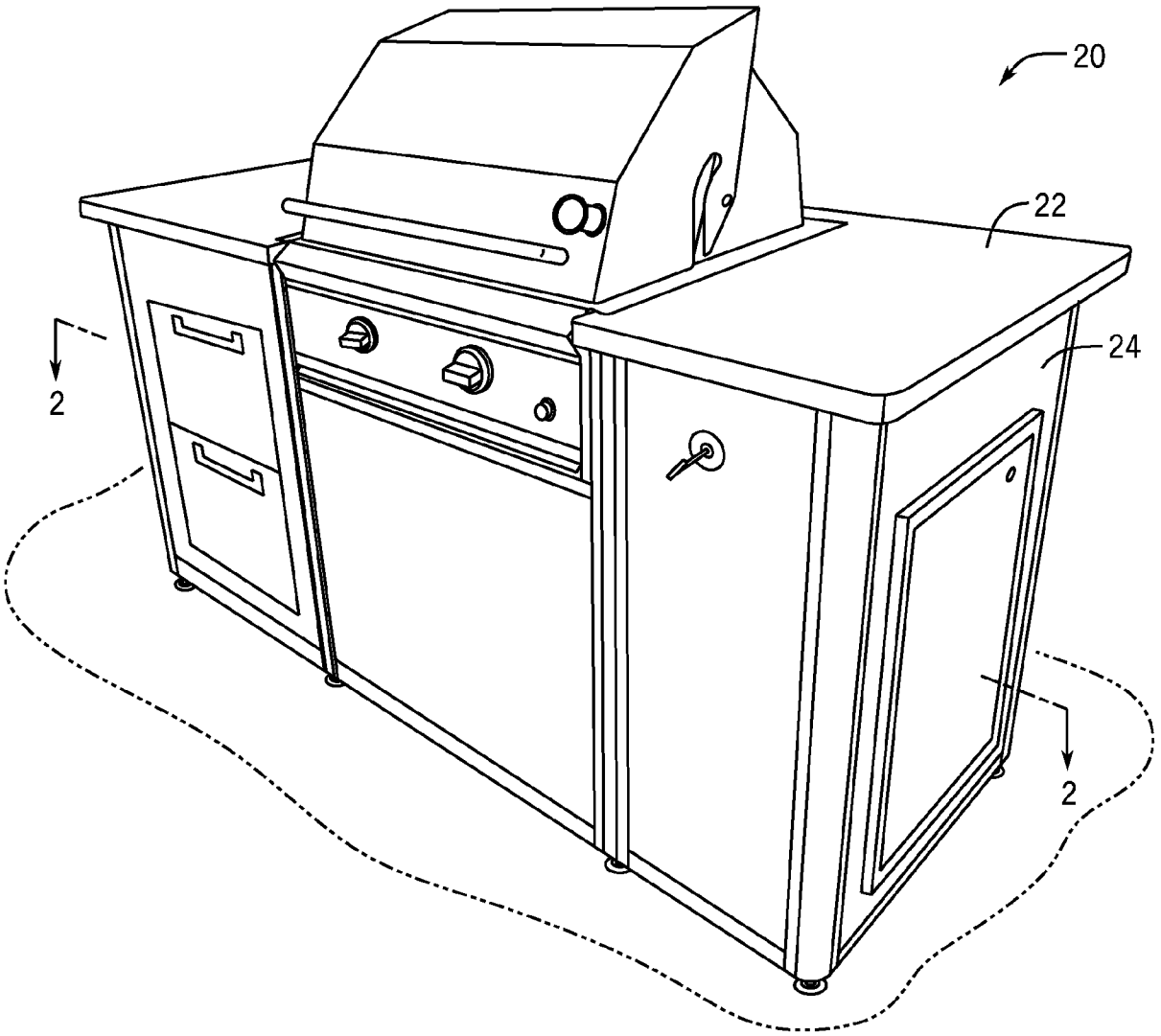
FIG. 1 is a perspective view of an outdoor modular system, according to an embodiment of the invention.

First referring to FIG. 1, an outdoor modular system 20 according to an embodiment of the invention is illustrated. In this embodiment, outdoor modular system 20 surrounds a gas grill having a generally standard construction and configuration. A countertop 22 is secured to the top of outdoor modular system 20 to provide a working station alongside the grill housed in outdoor modular system 20. While FIG. 1 depicts outdoor modular system 20 as a simple rectangular shape surrounding the gas grill, it is contemplated that outdoor modular system 20 may be constructed in multiple layouts to the satisfaction of a user.

FIG. 1 also depicts a variety of contemplated designs of decorative panels 24. The decorative panels 24 are made of polyurethane or metal and constructed to imitate a user's preferred exterior material to achieve the look of stucco, masonry, tile, wood, or other exterior materials without the cost associated with those products. While shown in FIG. 1 as being formed as flat panels that form a planar wall or surface of the system 20, the decorative panels 24 are not limited to a wall. It is contemplated that doors, drawers, and any combination thereof, may be constructed in any of the decorative panels 24, so as to give the user access to storage space within outdoor modular system 20.

Figure 2:
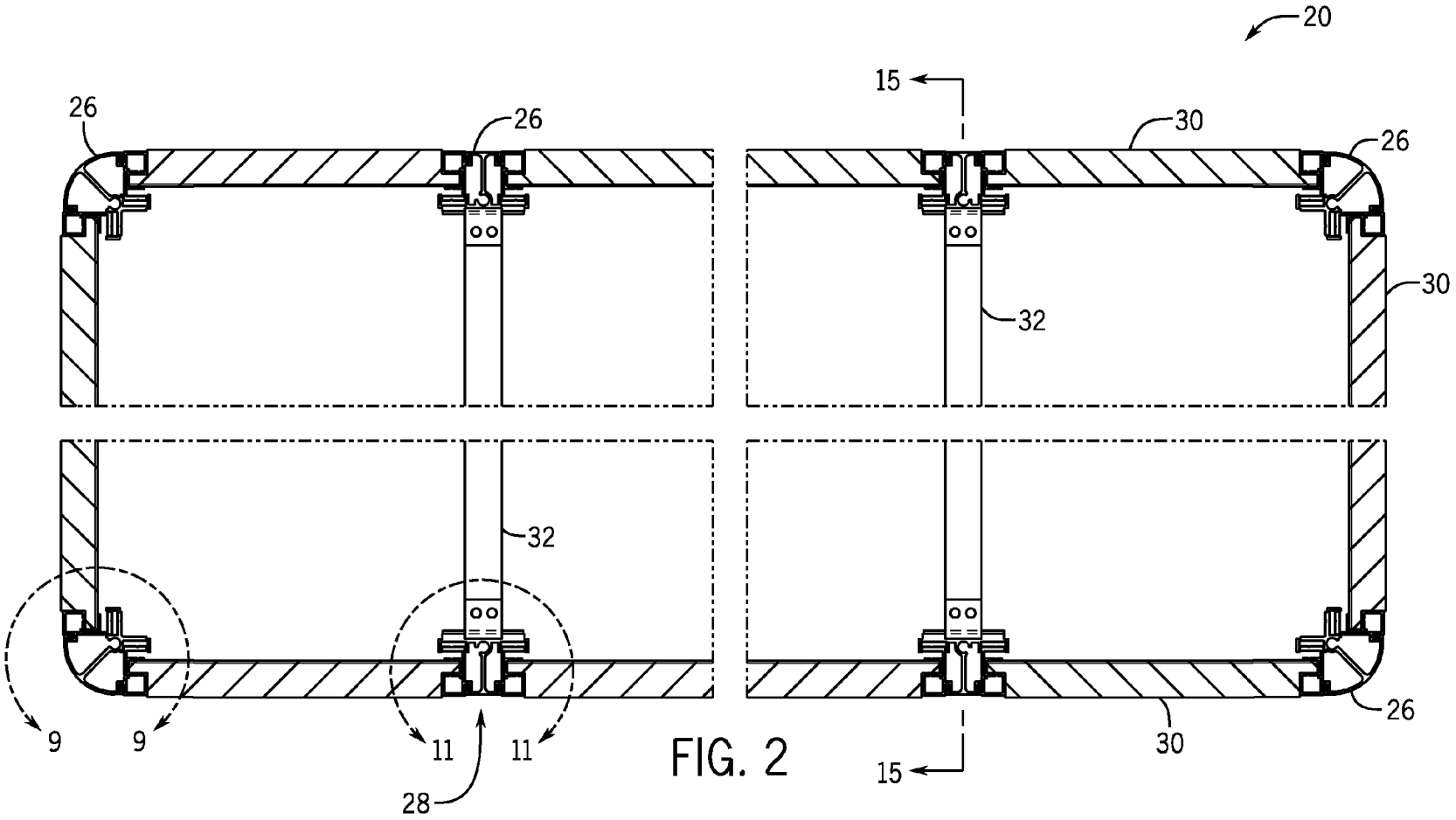
FIG. 2 is a cross-sectional view of the outdoor modular system of FIG. 1 taken along the line 2-2 of FIG. 1, according to an embodiment of the invention.

FIG. 2 depicts a cross-sectional view of outdoor modular system 20 taken along the line 2-2 of FIG. 1, and illustrates the components of outdoor modular system 20. A plurality of vertical support pieces 26 are placed at intervals along the exterior of outdoor modular system 20. Vertical support pieces 26 serve as a support structure for the various components used to create outdoor modular system 20, and may be formed from a custom cut or stock length extruded material, such as aluminum, steel, or plastic. It is also contemplated that vertical support pieces 26 may be constructed from wood. According to embodiments of the invention, vertical support pieces 26 may take a variety of shapes. In FIG. 2, vertical support pieces 26 are depicted as either lateral transition pieces or rounded corner pieces. However, one having ordinary skill in the art would recognize that vertical support pieces 26 could resemble numerous other shapes in order to create a desired footprint of outdoor modular system 20. Contemplated alternative designs of vertical support pieces 26 are shown and described in later figures. Regardless of the exact shape of the vertical support pieces 26, each vertical support piece 26 includes a configuration of notches, grooves, channels, and flanges that collectively form a "support piece mating feature"—generally identified as 28—configured to interfit with a panel wall assembly 30 in order to form a complete enclosure. It is contemplated that support piece mating feature 28 may be either formed in or attached to each vertical support piece 26.

Also included in outdoor modular system 20 is a support bar 32 extending between opposing vertical support pieces 26 located directly across outdoor modular system 20 from each other. Support bars 32 are attached to opposing vertical support pieces 26 and work as cross-beams to assist with supporting the structure. Support bars 32 also assist in squaring the structure. Later, this will be described in further detail.

Figure 3:
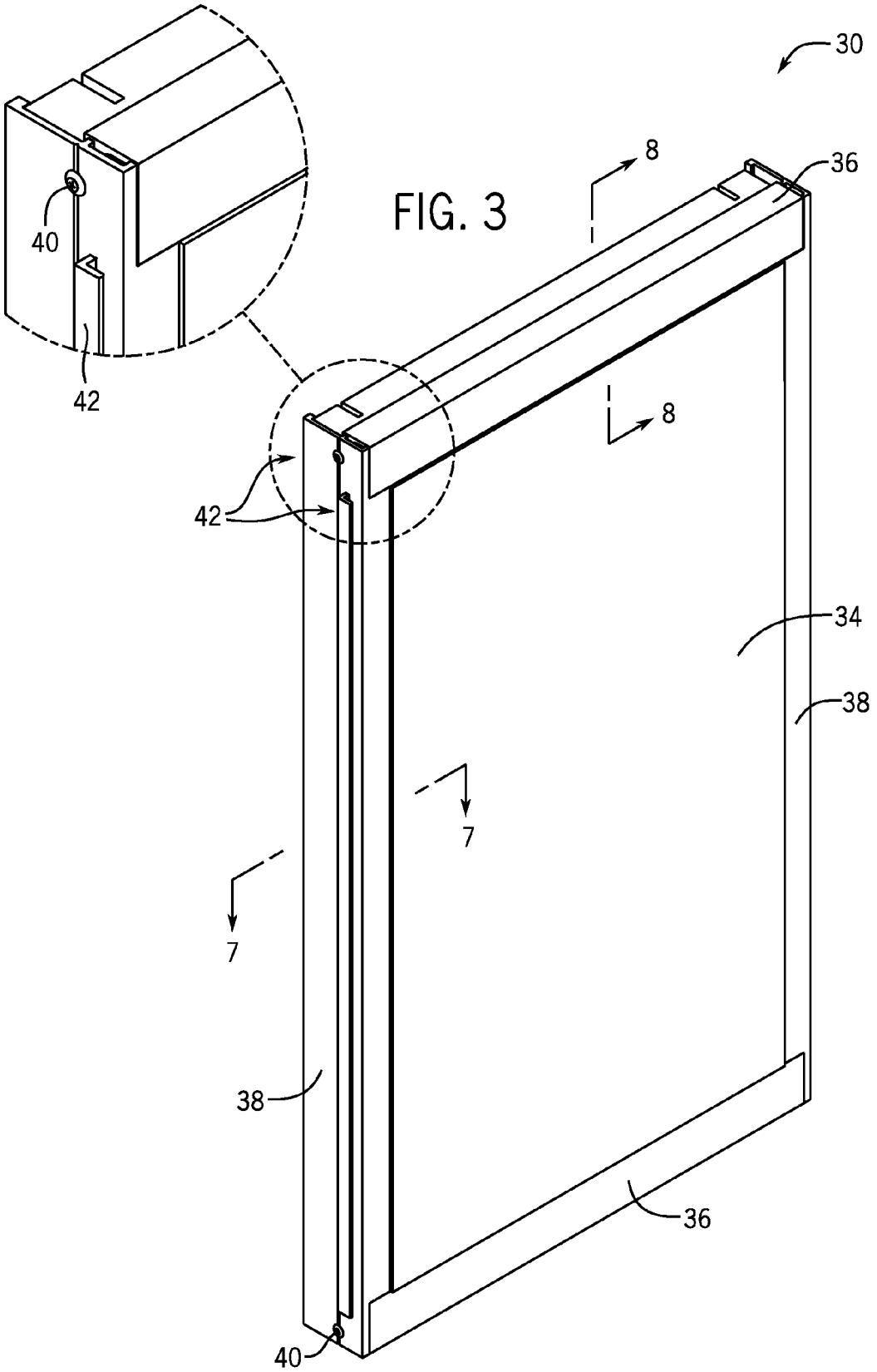
FIG. 3 is a perspective view of a panel wall assembly for use with the outdoor modular system of FIG. 1, according to an embodiment of the invention.

Referring now to FIGS. 3-8, the design and construction of panel wall assembly 30 is shown in greater detail. FIG. 3 shows a perspective view of panel wall assembly 30, with the panel wall assembly 30 including a decorative panel assembly 34, two (2) horizontal framing pieces 36 located at the top and bottom of decorative panel assembly 34, and two (2) vertical framing pieces 38 located on the left and right sides of decorative panel assembly 34. Horizontal framing pieces 36 and vertical framing pieces 32 are then secured to each other via fasteners 40. In this embodiment of the invention, fastener 40 is a screw, but one having ordinary skill in the art would recognize that a variety of fasteners could be used.

Horizontal framing pieces 36 and vertical framing pieces 38 may be custom cut or stock length extruded material, such as aluminum, steel, or plastic. In an alternative embodiment, framing pieces 36, 38 may also be constructed of wood. In addition, horizontal framing pieces 36 and vertical framing pieces 38 may contain any combination of notches, grooves, channels, and flanges so as to interfit with decorative panel assembly 34 to create panel wall assembly 30, and to further interfit with vertical support pieces 26 when panel wall assembly 30 is completed. The notches, grooves, channels, and flanges utilized to interfit with vertical support pieces 26 are collectively referred to as a "panel assembly mating feature" and are generally identified as 42, with it being recognized that the panel assembly mating feature 42 may be formed in or attached to framing pieces 36, 38.

Figure 4:
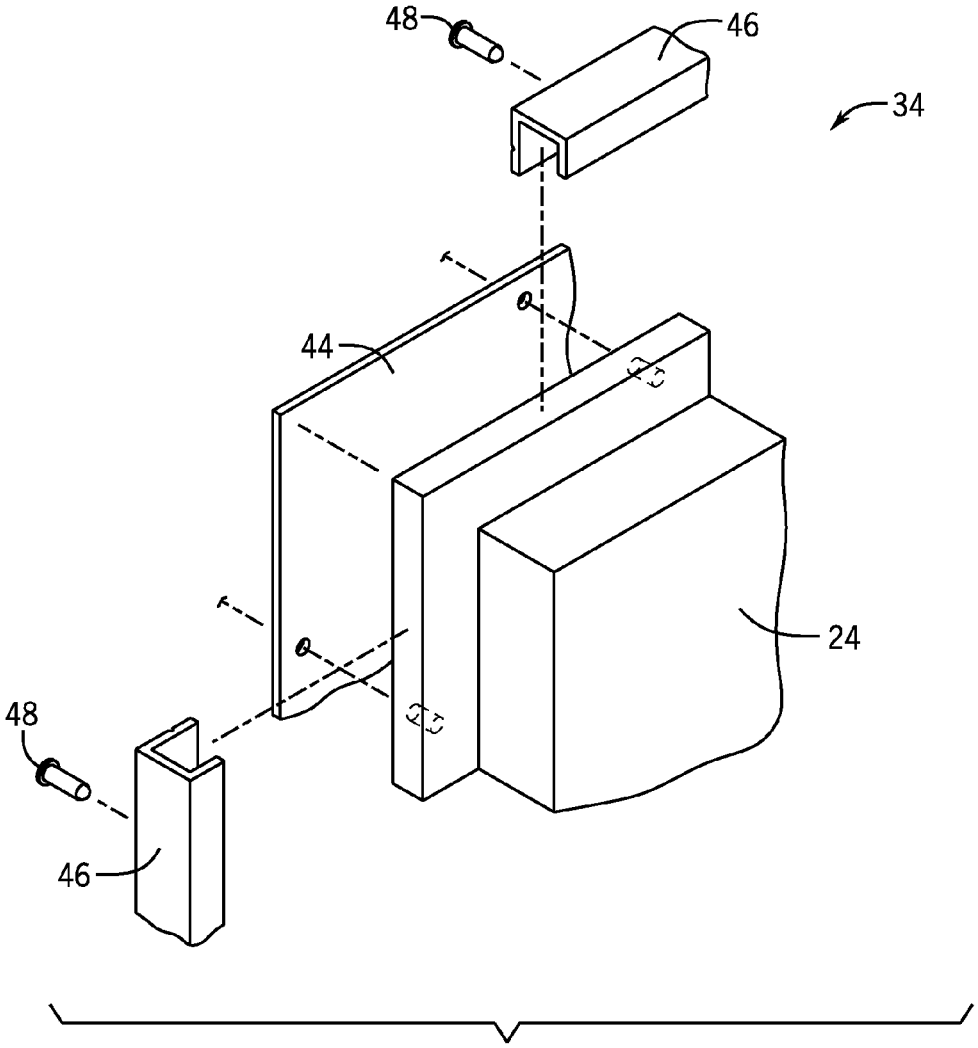
FIG. 4 is an exploded view of a corner of a decorative panel assembly, according to an embodiment of the invention.
Figure 5:
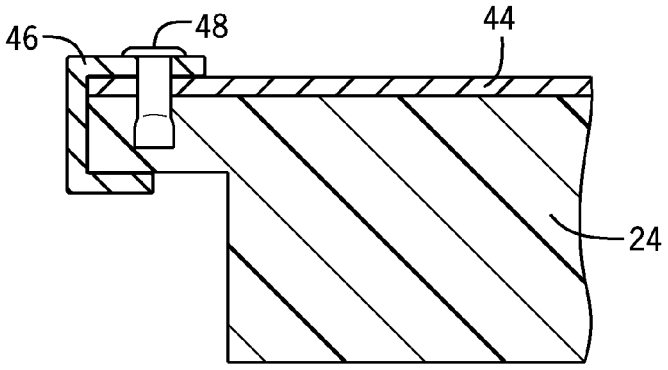
FIG. 5 is a cross-sectional view of the decorative panel assembly of FIG. 4, according to an embodiment of the invention.

FIGS. 4-5 depict the components of decorative panel assembly 34. FIG. 4 shows an exploded view wherein a backing plate 44 is aligned with decorative panel 24. It is contemplated that plate 44 may be constructed from any suitable material, such as aluminum, steel, wood, and plastic, so as to provide additional support to decorative panel 24. At least one panel clip 46 is then disposed along each edge of the combination of plate 44 and decorative panel 24 to secure plate 44 and decorative panel 24. While panel clip 46 is shown as an extruded C-shaped channel of metal, such as aluminum or steel, it is contemplated that panel clip 46 may be constructed as alternative shapes. Further, two fasteners 48 is used to secure each panel clip 46 to plate 44 and decorative panel 24. In this embodiment, fastener 48 is a pop rivet. However, one having ordinary skill in the art would recognize that a variety of other fasteners could be used. A cross-sectional view of the completed decorative panel assembly 34 is shown in FIG. 5, with the combination of plate 44, decorative panel 24, panel clip 46, and fastener 48 being shown therein. Here, it is clearly illustrated how fastener 48 secures the components of decorative panel assembly 34.

As mentioned previously, decorative panel 24 is designed to imitate the appearance of exterior building materials such as stucco, masonry, tile, wood, and the like. Imitation of exterior building materials allows decorative panel 24 to look and feel like the above listed building materials without having the associated weight and cost, which allows for cheaper and quicker construction. Decorative panels 24 may also be constructed from weather-resistant materials or may be coated in a weather resistant coating or other surface coating to increase durability.

Figure 6:
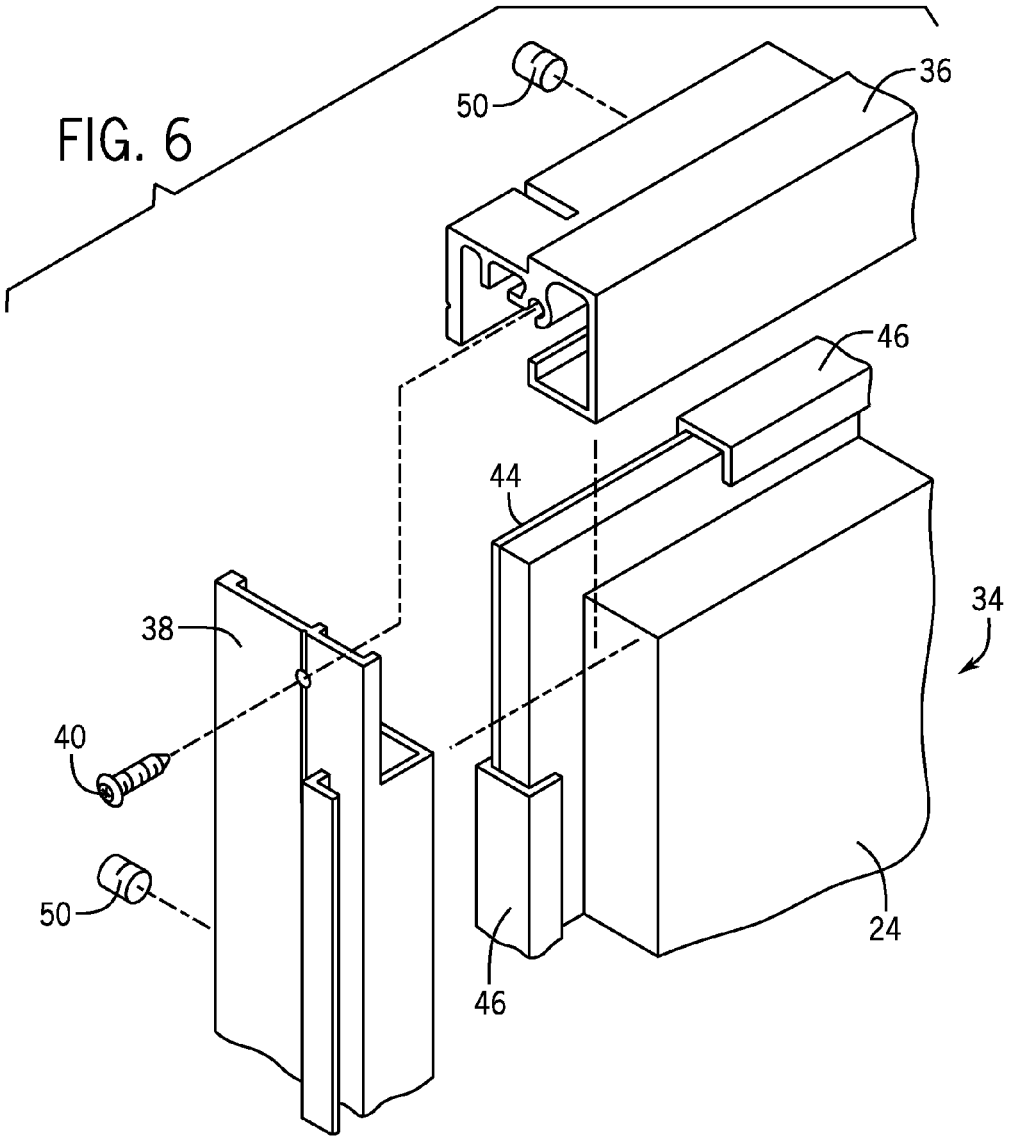
FIG. 6 is an exploded view of a corner of the panel assembly of FIG. 3, according to an embodiment of the invention.

Referring now to FIG. 6, an exploded view of panel wall assembly 30 is illustrated. Framing pieces 36, 38 are disposed along the outer edge of decorative panel assembly 34. In addition, framing pieces 36, 38 are secured to each other via at least one fastener 40 at each joint. As previously mentioned, fastener 40 is depicted as a screw; however, one having ordinary skill in the art would recognize that other fasteners may be used. FIG. 6 further shows the use of at least one fastener 50 as an additional measure to secure framing pieces 36, 38 to decorative panel assembly 34. In this embodiment, fastener 50 is shown to be an Allen screw, but one having ordinary skill in the art would recognize that alternative types of fasteners may be used, such as a set screw for example.

Figure 7:
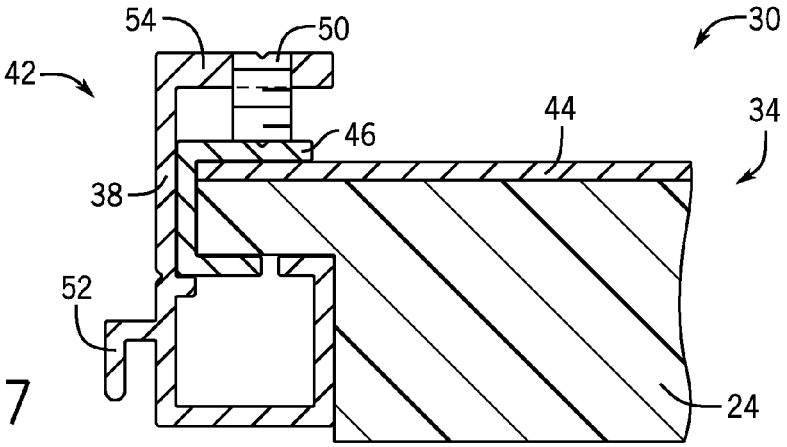
FIG. 7 is a cross-sectional view of the panel wall assembly of FIG. 3 taken along the line 7-7 of FIG. 3, according to an embodiment of the invention.

FIG. 7 illustrates a cross-sectional view of panel wall assembly 30 taken along line 7-7 of FIG. 3, showing the interaction between vertical framing piece 38 and decorative panel assembly 34. Vertical framing pieces 38 and horizontal framing pieces 36 (not shown) are put in place around the edge of decorative panel assembly 34. As shown in FIG. 7, each vertical framing piece 38 is designed to interfit with panel clip 46. In addition, at least one fastener 50 secures vertical framing piece 38 and panel clip 46. As set forth above, fastener 50 may be an Allen screw according to one embodiment of the invention, or alternatively could be a set screw or other suitable fastener.

Additionally, FIG. 7 shows two (2) L-shaped flanges 52, 54 formed in vertical framing piece 38. L-shaped flanges 52, 54 create panel assembly mating feature 42 and are designed to interact with support piece mating feature 28 of vertical support pieces 26, in order to help secure the connection of panel wall assembly 30 and vertical support pieces 26. The functionality of L-shaped flanges 52, 54 will be shown in later figures. In other embodiments of the invention, it is contemplated that alternative designs of flanges, notches, channels, and grooves may be formed in or attached to vertical framing piece 38, in order to have panel assembly mating feature 42 of vertical framing piece 38 interfit with support piece mating feature 28 of vertical support piece 26.

Figure 8:
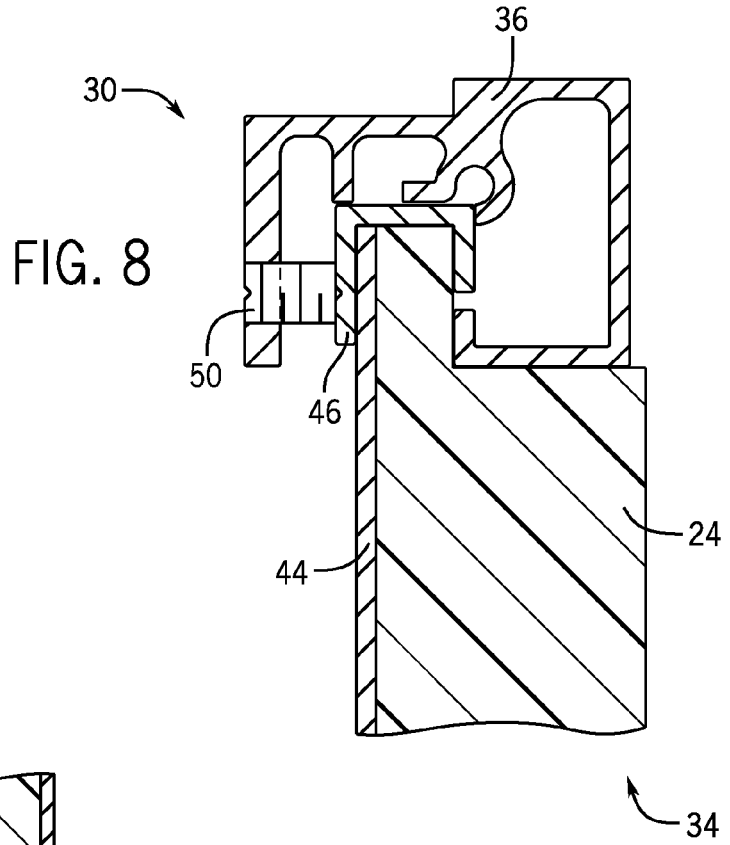
FIG. 8 is a cross-sectional view of the panel wall assembly of FIG. 3 taken along the line 8-8 of FIG. 3, according to an embodiment of the invention.

FIG. 8 shows a cross-sectional view of panel wall assembly 30 taken along line 8-8 of FIG. 3, showing the interaction between horizontal framing piece 36 and decorative panel assembly 34. As previously mentioned, vertical framing pieces 38 (not shown) and horizontal framing pieces 36 are put in place around the edge of decorative panel assembly 34. Each horizontal framing piece 36 is designed to interfit with panel clip 46. Further, at least one fastener 50 is used to secure horizontal framing piece 36 and panel clip 46. As mentioned with respect to FIG. 7, fastener 50 is illustrated as an Allen screw, but one having ordinary skill in the art would recognize that alternative fasteners, such as set screws, could be used.

In a preferred embodiment, fastener 50 applies pressure to panel clip 46 in order to lock decorative panel assembly 34 in framing pieces 36, 38. Fastener 50 further ensures that decorative panel assembly 34 is properly squared within framing pieces 36, 38.

In order to simplify construction for the user, the construction of panel wall assembly 30 may be completed prior to sending the product to the user. Therefore, the user would be able to take completed panel wall assemblies 30 and interfit them with vertical support pieces 26 to assemble outdoor modular system 20.

Figure 9:
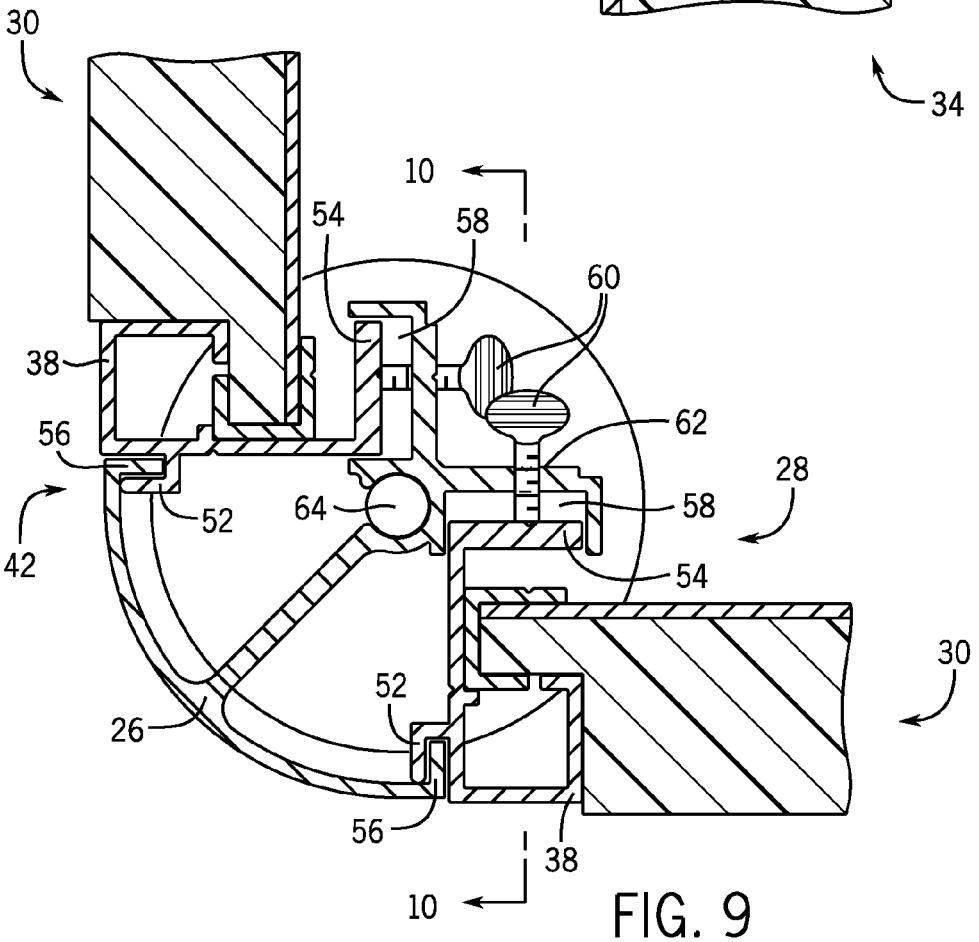
FIG. 9 is an enlarged view of the cross-section of FIG. 2 taken along the line 9-9 and focusing on the interaction between the panel wall assembly and a vertical support piece constructed as a rounded corner, according to an embodiment of the invention.

Now referring to FIG. 9, an enlarged view of the cross-section of FIG. 2 taken along the line 9-9 and focusing on the interaction between panel wall assembly 30 and vertical support piece 26 is shown. FIG. 9 depicts vertical support pieces 26 as a rounded corner piece. Flange 56 of vertical support piece 26 interfits with L-shaped flange 52 of vertical framing piece 38 of panel wall assembly 30. Further, L-shaped flange 54 of vertical framing piece 38 of panel wall assembly 30 interfits with a rear channel 58 of vertical support piece 26. In this embodiment of the invention, the combination of L-shaped flanges 52, 54 creates panel assembly mating feature 42, and the combination of flange 56 and rear channel 58 create support piece mating feature 28. It is contemplated that other embodiments may use any configuration of notches, grooves, channels, and flanges to form mating features 28, 42. The resulting interaction between panel assembly mating feature 42 and support piece mating feature 28 allows panel wall assembly 30 to vertically translate relative to/within vertical support piece 26. Once panel wall assembly 30 is interfit with vertical support piece 26 to the satisfaction of the user, at least one fastener 60 is used to secure panel wall assembly 30 and vertical support piece 26. Fastener 60 is positioned in a screw hole 62 formed in vertical support piece 26 and threaded thereto to apply a pressure to panel wall assembly 30 to secure it within vertical support piece 26. In this embodiment of the invention, fastener 60 is a thumb screw in order to allow for easy construction, but alternative types of fasteners may be used, such as a set screw.

As previously mentioned, FIG. 9 shows vertical support piece 26 as a rounded corner piece. The rounded corner design of vertical support pieces 26 allows for two (2) panel wall assemblies 30 to be joined perpendicular. This design and alternative designs of vertical support piece 26, depicted in later figures, allows the user to construct an outdoor modular system 20 of desired size and shape so as to enable the user to customize the construction of outdoor modular system 20.

Figure 10:
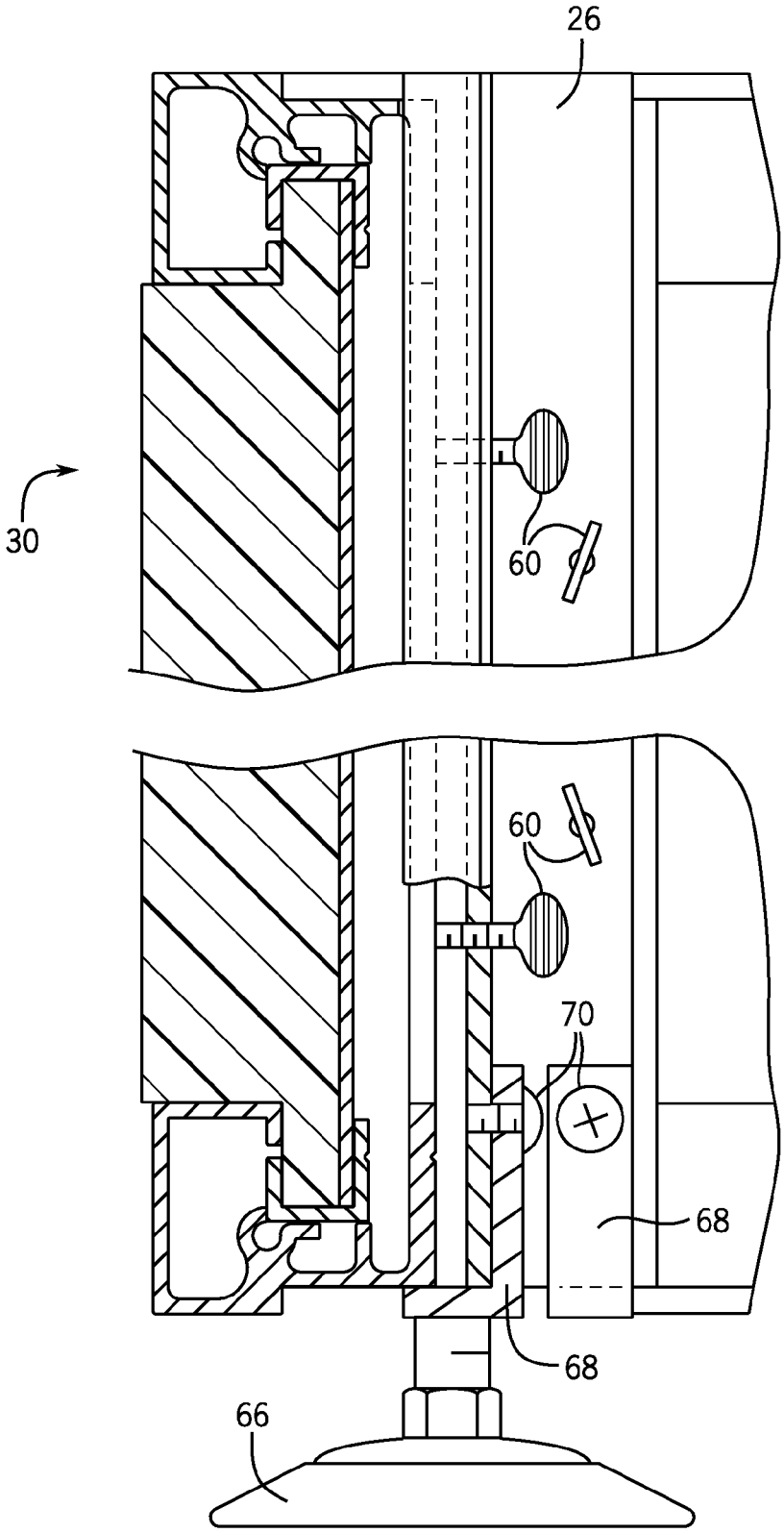
FIG. 10 is a cross-sectional view of FIG. 9 take along the line 10-10 and focusing on the interaction between the panel wall assembly and the vertical support piece shown in FIG. 9, according to an embodiment of the invention.

In addition, vertical support piece 26 includes a center channel 64 to interact with adjustable leg 66 (shown in FIG. 10). Adjustable leg 66 is positioned in center channel 64 and threaded thereto to allow variable positioning of adjustable leg 66. As a result, the user is able to adjust the height of outdoor modular system 20 to satisfy the needs of the user.

As shown in FIG. 10, a cross-sectional view of FIG. 9 taken along the line 10-10 further demonstrates the interaction between vertical support pieces 26 and panel wall assembly 30. As mentioned with respect to FIG. 9, vertical support pieces 26 and panel wall assembly 30 interfit, and panel wall assembly 30 is allowed to vertically traverse vertical support pieces 26 before being secured by fastener 60. FIG. 10 illustrates the addition of a bracket 68. Bracket 68 is disposed at the bottom edge of vertical support piece 26 in order align the bottom edge of panel wall assembly 30 with the bottom edge of vertical support piece 26 and create a flush bottom edge to outdoor modular system 20. As described above, at least one fastener 60 secures panel wall assembly 30 to vertical support pieces 26.

Further, bracket 68 is secured to vertical support piece 26 via at least one fastener 70. In FIG. 10, fastener 70 is shown to be a truss head Phillips screw; however, one having ordinary skill in the art would recognize that a variety of fasteners could be used to secure bracket 68 to vertical support piece 26. In addition, adjustable leg 66 is provided for outdoor modular system 20 that extends beyond the bottom edge of vertical support piece 26. Adjustable leg 66 allows for the user to adjust the height of outdoor modular system 20, resulting in a finished product that satisfies the needs of the user. As previously mentioned, adjustable leg 66 is positioned in channel 64 (shown in FIG. 9) and threaded thereto.

Figure 11:
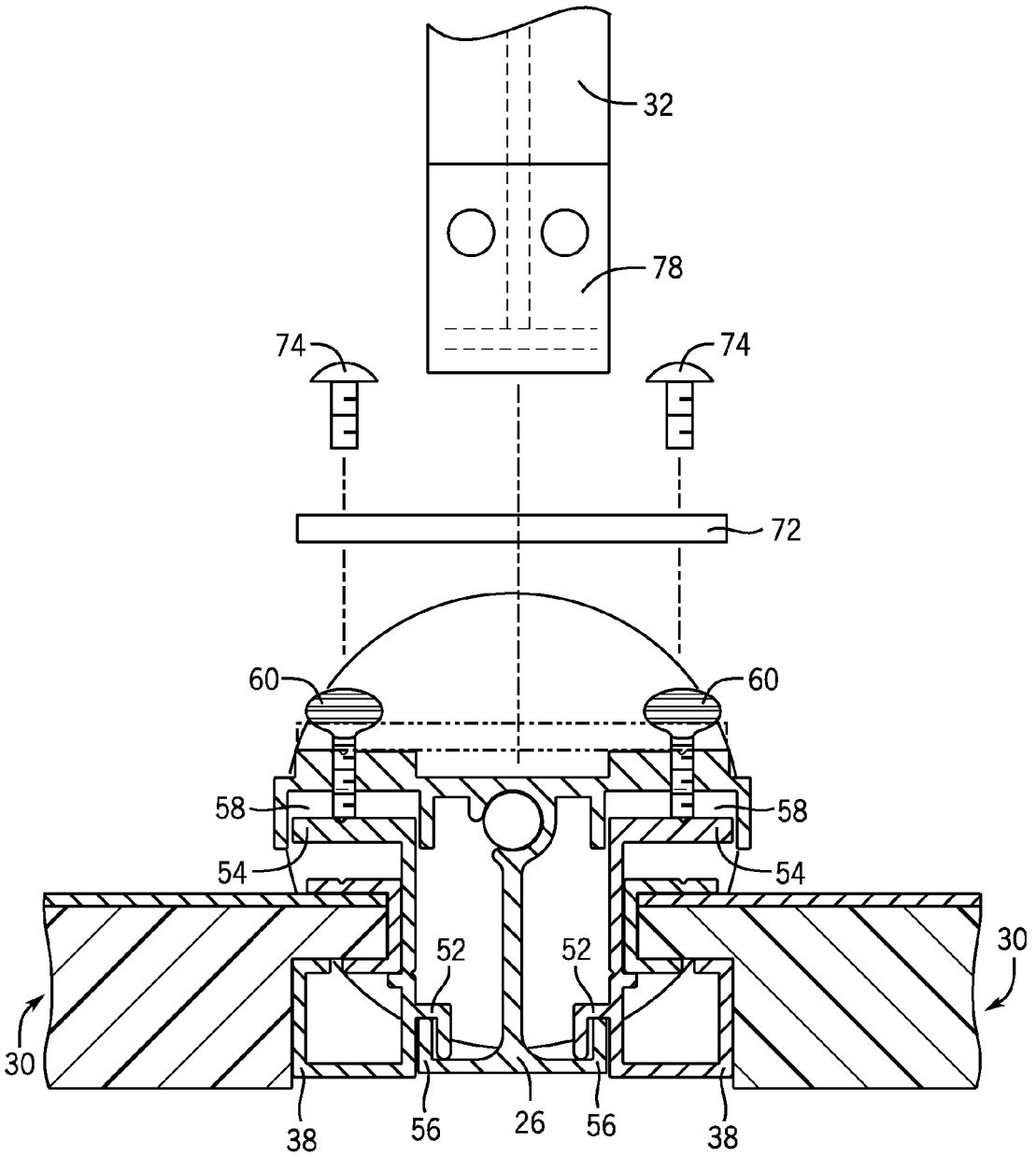
FIG. 11 is an enlarged view of the cross-section of FIG. 2 taken along the line 11-11 and focusing on the interaction between the panel wall assembly and a vertical support piece constructed as a lateral transition, according to an embodiment of the invention.

Next referring to FIG. 11, an enlarged view of the cross-section of FIG. 2 taken along the line 11-11 is shown and depicts the interaction between panel wall assembly 30 and vertical support piece 26. Whereas FIG. 9 depicts vertical support piece 26 as a rounded corner piece, FIG. 11 illustrates vertical support piece 26 as a lateral transition piece that would be found along a side of outdoor modular system 20. Vertical support piece 26 includes flange 56, which interfits with L-shaped flange 52 of vertical framing piece 38 of panel wall assembly 30. In addition, vertical support piece 26 includes rear channel 58 to interfit with L-shaped flange 54 of vertical framing piece 38 of panel wall assembly 30. As described with respect to FIG. 9, L-shaped flanges 52, 54 combine to make panel assembly mating feature 42, while flange 56 and rear channel 58 combine to make support piece mating feature 28. However, it is contemplated that other embodiments of the invention may use any combination of notches, grooves, channels, and flanges to form mating features 28, 42.

In addition, FIG. 11 shows a support plate 72 secured to vertical support piece 26 via fastener 74. In this embodiment of the invention, fasteners 74 are truss head machine screws. However, one having ordinary skill in the art would recognize that alternative fasteners may be used (e.g., Allen screws). Support bar 32 is secured to a bracket 78, a portion of which is disposed between support plate 72 and vertical support piece 26 in order to hold support bar 32. This will be described in greater detail later.

Figure 12:
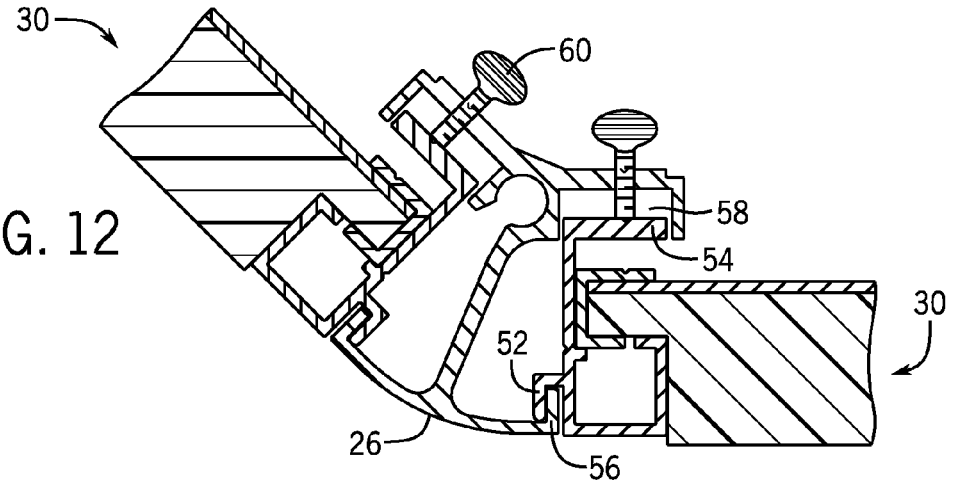
FIGS. 12-14 are cross-sectional views of an outdoor modular system focusing on the interaction between the panel wall assembly and a vertical support piece, and depicting a variety of vertical support piece constructions, according to an embodiment of the invention.
Figure 13:
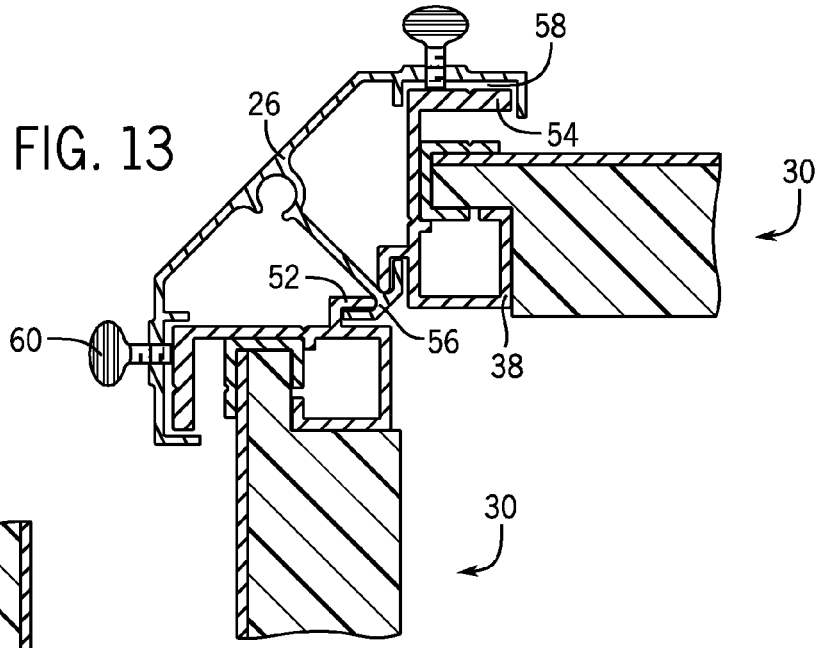
Figure 14:
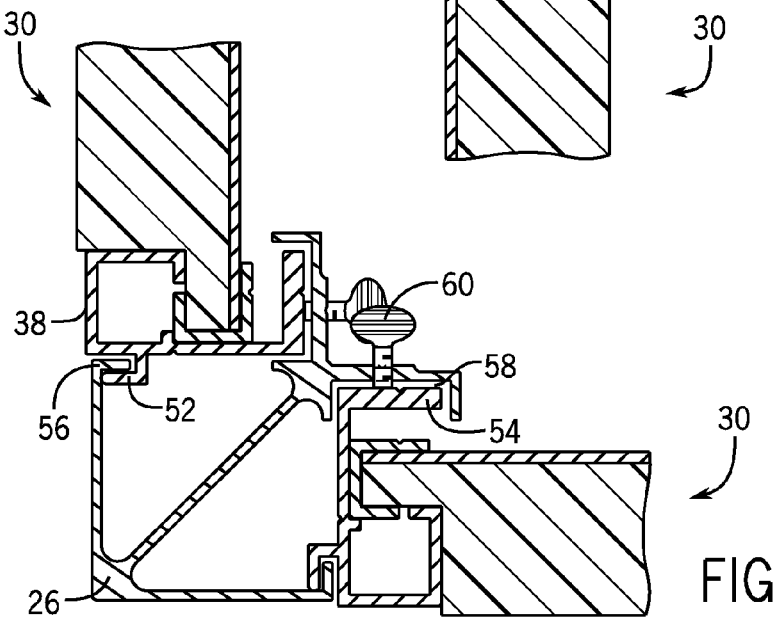

FIGS. 12-14 demonstrate alternative designs of vertical support piece 26, specifically of vertical support corner pieces. While the designs are different, each vertical support piece 26 is interfit with at least one panel wall assembly 30 the same way. As described with respect to FIGS. 9 and 11, vertical support piece 26 has flange 56 and vertical framing piece 38 of panel wall assembly 30 has flange 52. Flanges 52, 56 are designed to interfit with each other. Vertical support piece 26 also includes rear channel 58, which is designed to interfit with vertical framing piece 38 of panel wall assembly 30. While these embodiments of the invention show support piece mating feature 28 as including flange 56 and rear channel 58 and show panel assembly mating feature 42 as including flanges 52, 54, it is contemplated that mating features 28, 42 may be any combination of notches, grooves, channels, and flanges. In addition, once panel wall assembly 30 is interfit with vertical support piece 26 to the satisfaction of the user, at least one fastener 60 is used to secure panel wall assembly 30 and vertical support piece 26. To facilitate the use of fastener 60, screw hole 62 is formed in vertical support piece 26, and fastener 60 is positioned in screw hole 62 and threaded thereto. While fastener 60 is depicted as a thumb screw, other types of fasteners could be used, such as a set screw.

Each design illustrated in FIGS. 12-14 contributes to the user's ability to customize the design and construction of outdoor modular system 20 to his needs. In FIG. 12, vertical support piece 26 is designed as rounded piece, wherein two (2) panel wall assemblies 30 are joined at a 135 degree angle. FIG. 13 shows vertical support piece 26 as an inverted corner piece, wherein two (2) panel wall assemblies 30 are joined perpendicular, and the exterior of decorative panel 24 faces toward the corner. Meanwhile, FIG. 14 depicts vertical support piece 26 as a squared corner piece, wherein two (2) panel wall assemblies 30 are joined at a 90 degree angle.

While FIGS. 9 and 11-14 depict a variety of designs for vertical support piece 26, it is recognized that additional designs are also contemplated. For example, corners are depicted as both rounded and squared, but one having ordinary skill in the art would recognize that these corners could have alternative finishes, such as chamfering. In addition, corners are shown at a 90 degree angle (FIGS. 9, 13, and 14), a 135 degree angle (FIG. 12), a 180 degree angle (FIG. 11), and an inverted 90 degree angle (FIG. 13). It is contemplated that corners can range from a 0 degree angle to a 180 degree angle, and these ranges can also be inverted. This results in the ability to create any shaped corner, and, therefore, provide the user with the ability to completely customize his outdoor modular system 20.

Figure 15:
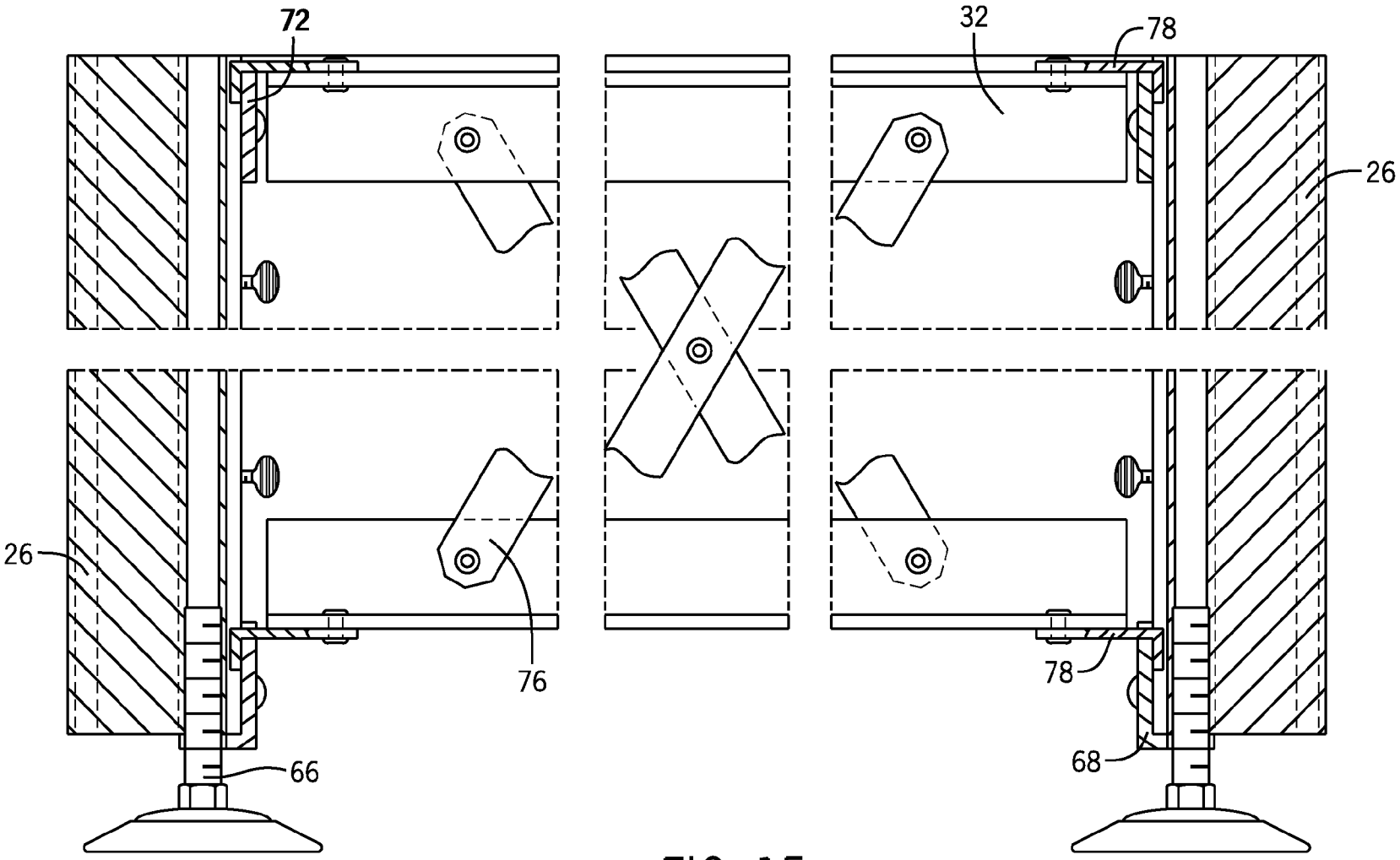
FIG. 15 is a cross-sectional view of the outdoor modular system of FIG. 2 taken along the line 15-15, according to an embodiment of the invention.

Referring now to FIG. 15, a cross-sectional view of FIG. 2 taken along the line 15-15 is provided. In one embodiment of the invention, support bar 32 is used to attach and support the top portions of opposite vertical support pieces 26, and an additional support bar 32 is used to attach and support the bottom portions of opposing vertical support pieces 26. In addition, a cross-support member 76 is attached to support bars 32, so as to provide additional support.

In one embodiment of the invention, support bar 32 is secured to bracket 78. In addition, a portion of bracket 78 is disposed between support plate 72 and vertical support piece 26 in order to attach support bar 32 to the top portion of vertical support piece 26, and a portion of bracket 78 is disposed between bracket 68 and vertical support piece 26 in order to attach support bar 32 to the bottom portion of vertical support piece 26. The design of bracket 78 illustrated in FIG. 15 allows for easy installation of support bar 32.

In summary, an outdoor modular system is provided that is designed to interfit panel wall assemblies with vertical support pieces so as to result in a simplified construction process. In addition, the panel wall assemblies are a part of the support structure of the outdoor modular system. As a result, the decorative panels, which are usually secured to the outside of the frame after the frame has been constructed, are secured in place while the frame is being constructed. This results in an easier and quicker construction process, while not sacrificing the customization of the outdoor modular system.

In accordance with one aspect of the invention, an outdoor modular system includes a plurality of vertical support pieces and a plurality of panel wall assemblies selectively engagable with the plurality of vertical support pieces, wherein a respective panel wall assembly is secured between a pair of adjacent vertical support pieces via one of thumb screws and set screws positioned in the screw holes of vertical support pieces. Each of the plurality of vertical support pieces include a support piece mating feature comprising at least one of notches, grooves, channels, and flanges, and a screw hole formed in the vertical support piece for receiving one of a thumb screw and a set screw therein. In addition, each panel wall assembly includes a set of vertical and horizontal framing pieces encompassing a decorative panel assembly, and at least one fastener configured to secure the set of vertical framing pieces to the set of horizontal framing pieces.

In accordance with another aspect of the invention, a method of constructing an outdoor modular system including providing a plurality of panel wall assemblies each comprising a decorative panel assembly surrounded by a set of vertical and horizontal panel framing pieces, providing a plurality of vertical support pieces that are mateable with the plurality of panel wall assemblies, and joining the plurality of panel wall assemblies to the plurality of vertical support pieces via a mating feature formed on each of the plurality of panel wall assemblies and each of the plurality of vertical support pieces, wherein the mating feature comprises at least one of notches, grooves, channels, and flanges formed therein that provide for a sliding engagement between a respective panel wall assembly and vertical support piece. In addition, the method includes securing the vertical support piece to the panel wall assemblies via at least one of one of a thumb screw and a set screw associated with each vertical support piece, wherein each of the one of the thumb screw and the set screw is threaded through a screw hole formed in the vertical support piece to apply a pressure to a respective panel wall assembly.

In accordance with yet another aspect of the invention, a panel wall assembly for use in a modular frame system, the panel wall assembly having a decorative panel assembly, a first and second vertical panel framing piece and a first and a second horizontal panel framing piece positioned about the decorative panel assembly so as to encompass the decorative pane assembly, and a plurality of fasteners to secure the first and second vertical panel framing pieces to the first and second horizontal panel framing pieces. Additionally, each of the first and second vertical panel framing pieces includes a first and second flange to interfit with a third flange and a channel of a vertical support piece of the modular frame system via a vertical sliding engagement.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An outdoor modular system comprising:

a plurality of vertical support pieces, each of the plurality of vertical support pieces including:

a support piece mating feature comprising at least one of notches, grooves, channels, and flanges; and a screw hole formed in the vertical support piece for receiving one of a thumb screw and a set screw therein; and a plurality of panel wall assemblies selectively engagable with the plurality of vertical support pieces, each panel wall assembly comprising:

a set of vertical framing pieces and a set of horizontal framing pieces encompassing a decorative panel assembly; and at least one fastener configured to secure the set of vertical framing pieces to the set of horizontal framing pieces;

wherein each of the set of vertical framing pieces includes a panel assembly mating feature comprising at least one of notches, grooves, channels, and flanges, the panel assembly mating feature configured to interfit with a respective support piece mating feature; and wherein a respective panel wall assembly is secured between a pair of adjacent vertical support pieces via one of thumb screws and set screws positioned in the screw holes of the vertical support pieces, the one of the thumb screws and the set screws positioned within the screw holes such that they are tightened against a surface of the panel wall assembly to apply pressure to the surface of the panel wall assembly and secure the panel wall assembly relative to the pair of adjacent vertical support pieces.

2. The system of claim 1 wherein the plurality of vertical support pieces comprise one of extruded aluminum and extruded steel.

3. The system of claim 2 wherein the plurality of vertical support pieces are constructed as at least one of a rounded corner piece, a lateral transition piece, an angled piece, an inverted corner piece, and an edged corner piece.

4. The system of claim 3 wherein the angled piece is constructed at one of any angle between 0 degrees and 180 degrees.

5. The system of claim 2 wherein each of the plurality of vertical support pieces further comprises a bracket secured to a bottom edge of the vertical support piece, wherein a respective panel wall assembly rests on the bracket so as to align a bottom edge of the panel wall assembly to the bottom edge of the vertical support piece.

6. The system of claim 1 wherein the decorative panel assembly comprises a decorative panel, wherein the decorative panel is composed of one polyurethane and metal.

7. The system of claim 6 wherein the decorative panel is constructed to imitate one of stucco, masonry, tile, and wood.

8. The system of claim 6 wherein the decorative panel assembly further comprises a back plate and a plurality of C-Shaped panel clips; and wherein the decorative panel, back plate, and plurality of C-Shaped panel clips are all secured via a second fastener.

9. The system of claim 8 wherein the plurality of C-shaped panel clips interfit with the set of vertical framing pieces and the set of horizontal framing pieces, and wherein the decorative panel assembly further comprises additional fasteners that secure the vertical and horizontal framing pieces to the C-shaped panel clips.

10. The system of claim 6 wherein the decorative panel assembly further comprises a door constructed in the decorative panel.

11. The system of claim 1 further comprising at least one support bar connecting vertical support pieces located on opposing sides of the outdoor modular system.

12. The system of claim 1 wherein the panel assembly mating feature of each of the plurality of vertical framing pieces comprises a first L-shaped flange and a second L-shaped flange.

13. The system of claim 12 wherein the support piece mating feature of each of the plurality of vertical support pieces comprises:

a pair of L-shaped flanges generally positioned at a first side of the vertical support piece; and a pair of rear channels generally positioned at a second side of the vertical support piece opposite the first side;

wherein each of the pair of L-shaped flanges interfits with the first L-shaped flange of respective vertical framing pieces positioned on either side of the vertical support piece; and wherein each of the pair of rear channels interfits with the second L-shaped flange of respective vertical framing pieces positioned on either side of the vertical support piece.

14. The system of claim 1 further comprising an adjustable leg mateable with a respective vertical support piece of the plurality of vertical support pieces, and wherein each of the plurality of vertical support pieces includes a threaded center channel formed therein configured to receive the adjustable leg therein and allow variable positioning of the adjustable leg.

15. An outdoor modular system comprising:

a plurality of vertical support pieces, each of the plurality of vertical support pieces including:

a support piece mating feature comprising a plurality of L-shaped flanges, with a portion of the L-shaped flanges defining rear channels for the support piece mating feature; and a screw hole formed in two of the plurality of L-shaped flanges for receiving one of thumb screws and set screws therein; and a plurality of panel wall assemblies selectively engagable with the plurality of vertical support pieces, each panel wall assembly comprising:

a set of vertical framing pieces and a set of horizontal framing pieces encompassing a decorative panel assembly; and at least one fastener configured to secure the set of vertical framing pieces to the set of horizontal framing pieces;

wherein each of the set of vertical framing pieces includes a panel assembly mating feature comprising a plurality of L-shaped flanges, the plurality of L-shaped flanges of the panel assembly mating feature configured to interfit with a respective L-shaped flange and rear channel of the support piece mating feature; and wherein a respective panel wall assembly is secured between a pair of adjacent vertical support pieces via one of thumb screws and set screws positioned in the screw holes of the vertical support pieces.

* * * * *